US007455289B2

(12) United States Patent
Ito

(10) Patent No.: US 7,455,289 B2
(45) Date of Patent: Nov. 25, 2008

(54) PAPER FEEDER AND IMAGE FORMING APPARATUS HAVING THE SAME

(75) Inventor: Yoshiyuki Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 549 days.

(21) Appl. No.: 10/809,513

(22) Filed: Mar. 26, 2004

(65) Prior Publication Data

US 2004/0251597 A1 Dec. 16, 2004

(30) Foreign Application Priority Data

Mar. 28, 2003 (JP) ..... 2003-090619

(51) Int. Cl.
*B65H 1/00* (2006.01)

(52) U.S. Cl. ..... 271/162; 271/9.01; 271/164

(58) Field of Classification Search ..... 292/DIG. 18; 70/78, 79, 85; 312/219, 217, 216; 399/391, 399/393; 902/13; 271/145, 162, 164, 9.01, 271/9.11, 9.12, 9.13; 221/287, 197, 154; 347/104; 74/52

See application file for complete search history.

(56) References Cited

U.S. PATENT DOCUMENTS

| | | | | | |
|---|---|---|---|---|---|
| 1,492,808 | A | * | 5/1924 | Pinckney | 192/69.82 |
| 2,023,579 | A | * | 12/1935 | Dodge | 74/148 |
| 2,040,933 | A | * | 5/1936 | Gillen | 74/319 |
| 3,886,805 | A | * | 6/1975 | Koderman | 74/52 |
| 4,186,614 | A | * | 2/1980 | Hamlin | 74/63 |
| 4,534,252 | A | * | 8/1985 | Harrington et al. | 83/310 |
| 5,413,009 | A | * | 5/1995 | Fragnito | 74/63 |
| 5,785,308 | A | * | 7/1998 | Flores et al. | 271/9.11 |
| 5,915,802 | A | * | 6/1999 | Siler | 312/216 |
| 6,895,873 | B1 | * | 5/2005 | Searle | 109/25 |

FOREIGN PATENT DOCUMENTS

| | | | |
|---|---|---|---|
| JP | B2 63-44649 | | 9/1988 |
| JP | 4-217521 | * | 8/1992 |
| JP | U 4-89363 | | 8/1992 |
| JP | 5-69959 | * | 3/1993 |
| JP | 6-64764 | * | 3/1994 |
| JP | A 7-215491 | | 8/1995 |
| JP | A-07-286461 | | 10/1995 |
| JP | B2 2578522 | | 11/1996 |
| JP | A 9-190133 | | 7/1997 |
| JP | 9-222756 | * | 8/1997 |
| JP | A-10-179289 | | 7/1998 |
| JP | A 11-208969 | | 8/1999 |
| JP | A-2001-121795 | | 5/2001 |
| JP | A 2001-121795 | | 5/2001 |
| JP | A 2001-209227 | | 8/2001 |

* cited by examiner

*Primary Examiner*—Patrick H Mackey
*Assistant Examiner*—Thomas A Morrison
(74) *Attorney, Agent, or Firm*—Oliff & Berridge, PLC

(57) ABSTRACT

A paper feeder includes: a first paper feed cassette in which to store a recording medium with a lock state; a locking portion that determines whether to bring the lock state of the first paper feed cassette into the unlocked state or the locked state; a second paper feed cassette in which to store a recording medium, capable of selectively entering an unlocked state and a locked state; and a lock state transmitting portion that transmits the lock state of the first paper feed cassette to the second paper feed cassette to bring the second paper feed cassette into the unlocked state or the locked state in accordance with the lock state of the first paper feed cassette.

13 Claims, 8 Drawing Sheets

PAPER FEEDER AND IMAGE FORMING APPARATUS HAVING THE SAME

BACKGROUND OF THE INVENTION

1. Field of the Invention

The present invention relates to a paper feeder for storing recording media and an image forming apparatus having the paper feeder, and particularly relates to a paper feeder capable of locking each paper feed cassette to prevent recording media stored in the paper feed cassette from being taken out freely from the paper feed cassette, and an image forming apparatus having the paper feeder.

2. Background Art

Paper feed cassettes of an image forming apparatus such as a printer are generally filled with sheets of plain paper. Occasionally, however, by use of mica toner containing magnetic powder or the like, numeric characters may be printed on securities such as checks charged into a paper feed cassette. The checks or the like subjected to printing thus can be used immediately for economic transactions. From such convenience, printers have been increasingly used for such applications in recent years.

When a printer is used for such applications, it is necessary to protect the securities in the paper feed cassette from theft. In order to prevent theft, therefore, in the background art, a locking unit or the like is provided for preventing recording media in a paper feed cassette from being taken out freely when printing is performed on securities (see JP-A-2001-121795, page 3, FIG. 1).

SUMMARY OF THE INVENTION

In the aforementioned document, the case for only one paper feed cassette is taken into consideration, but the case for a plurality of paper feed cassettes is not taken into consideration. When a plurality of paper feed cassettes are provided in the technique disclosed in the aforementioned document, a plurality of locking units must be provided for the paper feed cassettes respectively, and a user must lock the paper feed cassettes individually. Such an operation is troublesome for the user and also disadvantageous in terms of cost. With the number of paper feed cassettes increasing, the technique is more disadvantageous in terms of workability or cost.

A paper feeder capable of locking a plurality of paper feed cassettes in an easy operation, and an image forming apparatus having the paper feeder is disclosed herein.

According to an aspect of the invention, a paper feeder includes: a first paper feed cassette in which to store a recording medium with a lock state that is selected from an unlocked state where the recording medium can be taken out therefrom and a locked state where the recording medium cannot be taken out therefrom; a locking portion that determines whether to bring the lock state of the first paper feed cassette into the unlocked state or the locked state; a second paper feed cassette in which to store a recording medium, capable of selectively entering an unlocked state where the recording medium can be taken out therefrom and a locked state where the recording medium cannot be taken out therefrom; and a lock state transmitting portion that transmits the lock state of the first paper feed cassette to the second paper feed cassette to bring the second paper feed cassette into the unlocked state or the locked state in accordance with the lock state of the first paper feed cassette.

BRIEF DESCRIPTION OF THE DRAWINGS

The present invention may be more readily described with reference to the accompanying drawings.

DETAILED DESCRIPTION OF THE PREFERRED EMBODIMENTS

Preferred embodiments of the invention will be described below with reference to the drawings.

Figure 1:
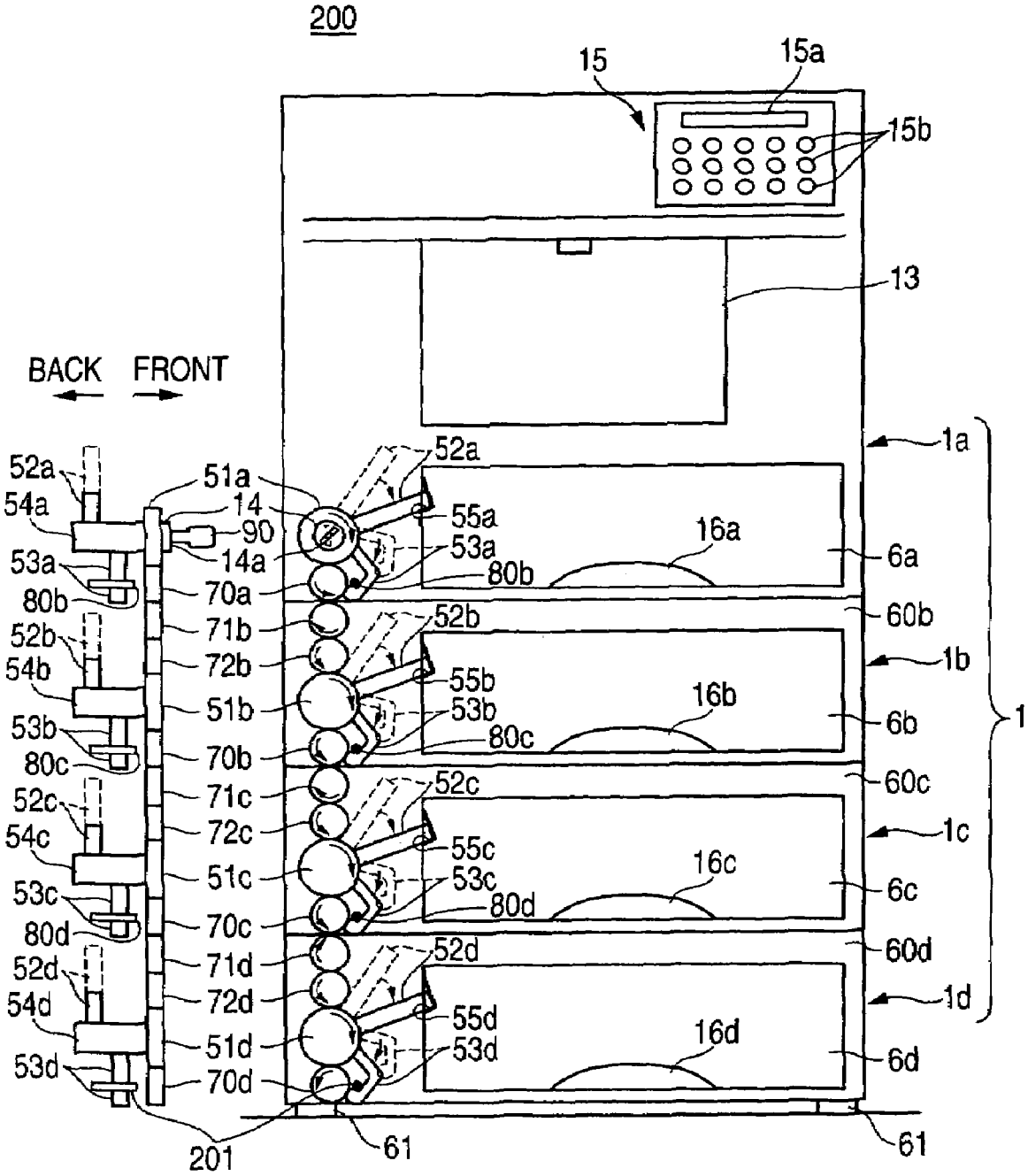
FIG. 1 is a front perspective view showing a laser printer according to a first embodiment of the invention, with an explanatory side view of a gang lock unit provided in the laser printer.

FIG. 1 is a front perspective view showing a laser printer according to a first embodiment of the invention, with an explanatory side view of a gang lock unit provided in the laser printer. The laser printer 1 is constituted by a printer body 1*a* and a stack of three paper feed cassette units 1*b*, 1*c* and 1*d* disposed under the printer body 1*a*. The paper feed cassette units 1*b*, 1*c* and 1*d* are separate from the printer body 1*a* and have the same configuration as one another. Each paper feed cassette unit 1*b*, 1*c*, 1*d* can be removably attached to the printer body 1*a*. A user can remove the paper feed cassette unit desirably or install another paper feed cassette unit having the same configuration additionally. More in particular, the printer body 1*a* and the paper feed cassette units have foot portions in their bottom surface respectively (only foot portions 61 of the lowest paper feed cassette unit 1*d* are shown in FIG. 1). The printer body 1*a* and the paper feed cassette units are disposed in a stack without any misalignment due to the foot portions 61 engaging with lower units respectively.

Here, each member is denoted by a reference numeral with a suffix "a", "b", "c" or "d" showing which one of the printer body 1*a* and the paper feed cassette units 1*b*, 1*c*, 1*d* the member belongs to.

A paper feed cassette 6*a* storing securities such as checks as recording media is provided in the printer body 1*a* removably in a direction perpendicular to the paper of FIG. 1. Similarly in each paper feed cassette unit 1*b*, 1*c*, 1*d*, a paper feed cassette 6*b*, 6*c*, 6*d* is provided removably in a unit body 60*b*, 60*c*, 60*d*. Incidentally, a recess portion 16*a*, 16*b*, 16*c*, 16*d* for making the user easier to put his/her fingers therein when he or she pulls out each paper feed cassette 6*a*, 6*b*, 6*c*, 6*d* is formed at the front of the paper feed cassette 6*a*, 6*b*, 6*c*, 6*d*.

A gang lock unit is provided on the front left side of each paper feed cassette 6*a*, 6*b*, 6*c*, 6*d*. The gang lock unit performs gang locking as follows. That is, as soon as the paper feed cassette 6*a* provided in the printer body 1*a* is brought into a locked state, the gang lock unit automatically brings the paper feed cassettes 6*b*, 6*c* and 6*d* of the paper feed cassette units 1*b*, 1*c* and 1*d* stacked under the printer body 1*a*, into the locked state.

Incidentally, the locked state means a state where the paper feed cassette 6*a*, 6*b*, 6*c*, 6*d* is prohibited from being pulled out, so that checks 3 in the paper feed cassette 6*a*, 6*b*, 6*c*, 6*d* cannot be taken out. An unlocked state means a state where the paper feed cassette 6*a*, 6*b*, 6*c*, 6*d* is allowed to be pulled out so that the checks 3 can be taken out.

A tag 14 is exposed to the apparatus front on the left side of the paper feed cassette 6*a* of the printer body 1*a* (see FIG. 2), while a lock gear 51*a*, a cylinder 54*a* fixed to the back side of the lock gear 51*a*, and so on, are stored in the apparatus. That is, all the members of the gang lock unit but the tag 14 provided on the left side of the paper feed cassette 6*a* of the printer body 1*a* are stored in each unit but invisibly from the front surface. However, in order to make the description easier, those members are shown by the solid lines in the front view on the right side of FIG. 1, and shown schematically in the explanatory view on the left side of FIG. 1.

A key hole 14*a* to which a key 90 can be inserted is formed in the tag 14. The key hole 14*a* is formed continuously in the lock gear 51*a* and the cylinder 54*a* in the printer body 1*a* which will be described later. That is, the front end of the key 90 is designed to penetrate the tag 14 and the lock gear 51*a* and reach the inside of the cylinder 54*a*.

Lock gears 51*a*, 51*b*, 51*c* and 51*d* are provided correspondingly to the paper feed cassette 6*a* of the printer body 1*a* and the paper feed cassettes 6*b*, 6*c* and 6*d* of the paper feed cassette units 1*b*, 1*c* and 1*d* respectively. Each lock gear 51*a*, 51*b*, 51*c*, 51*d* is a circular plate-like member having a gearing groove formed in its circumferential edge. A columnar cylinder 54*a*, 54*b*, 54*c*, 54*d* is fixed to the back side of the lock gear 51*a*, 51*b*, 51*c*, 51*d*.

A hook 53*a*, 53*b*, 53*c*, 53*d* and a locking bar 52*a*, 52*b*, 52*c*, 52*d* are fixed to the circumferential surface of the cylinder 54*a*, 54*b*, 54*c*, 54*d* in turn in order of increasing distance from the tag 14. Accordingly, the cylinder 54*a*, 54*b*, 54*c*, 54*d* rotates with the rotation of the lock gear 51*a*, 51*b*, 51*c*, 51*d* in the locking operation, so that the hook 53*a*, 53*b*, 53*c*, 53*d* and the locking bar 52*a*, 52*b*, 52*c*, 52*d* fixed to the cylinder 54*a*, 54*b*, 54*c*, 54*d* also rotate together.

Each locking bar 52*a*, 52*b*, 52*c*, 52*d* is a bar-like member which is received in a recess portion 55*a*, 55*b*, 55*c*, 55*d* provided in the locking-portion-side side surface of the paper feed cassette 6*a*, 6*b*, 6*c*, 6*d* in the locked state. In FIG. 1, the locking bars 52*a*, 52*b*, 52*c* and 52*d* in the locked state are shown by the solid lines and in the unlocked state are shown by the broken lines.

A grappling portion is formed at the tip of each hook 53*a*, 53*b*, 53*c*, 53*d*. The hooks 53*a*, 53*b* and 53*c* except for the lowest hook 53*d* engage with hook destinations 80*b*, 80*c* and 80*d* provided to project on the top of the unit bodies 60*b*, 60*c* and 60*d* in the paper feed cassette units 1*b*, 1*c* and 1*d*, respectively. Each hook destination 80*b*, 80*c*, 80*d* is a bar extending perpendicularly to the paper of FIG. 1. The hook destination 80*b*, 80*c*, 80*d* is attached to be put between two vertical members (not shown) attached to the top of the paper feed cassette unit 1*b*, 1*c*, 1*d*. Thus, the hook destination 80*b*, 80*c*, 80*d* is disposed to project on the top of the unit body 60*b*, 60*c*, 60*d*.

Figure 5A:
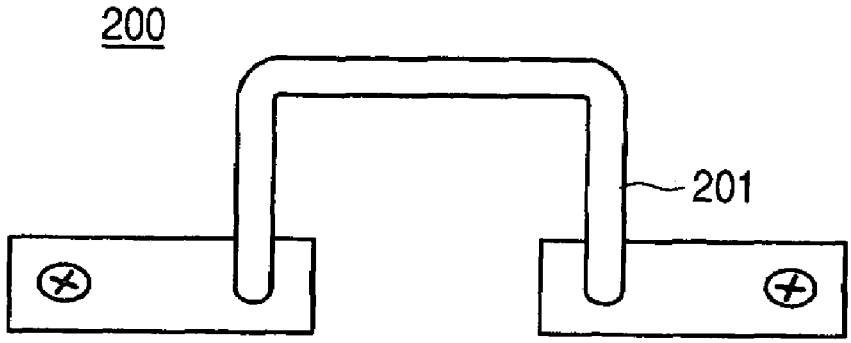
FIG. 5A is a schematic perspective view showing a printer fixing bar provided in a support base for supporting the laser printer according to the first embodiment of the invention.

On the other hand, the hook 53*d* provided for the paper feed cassette 6*d* closest to a support base 200 supporting the apparatus engages with a printer fixing bar 201 provided in the support base 200. The printer fixing bar 201 is a U-shaped member, which is attached to project from the surface of the support table 200 as shown in FIG. 5A. The support base 200 provided with the printer fixing bar 201 thus is sold, particularly as a support of the laser printer 1 according to this embodiment, in set with the laser printer 1.

Incidentally, in the same manner as the locking bars 52*a*, 52*b*, 52*c* and 52*d*, in FIG. 1, the hooks 53*a*, 53*b*, 53*c* and 53*d* in the hooked state are also shown by the solid lines and in the unhooked state are also shown by the broken lines.

The lock gears 51*a* and 51*b* are connected to each other through three transmission gears 70*a*, 71*b* and 72*b* disposed between the lock gears 51*a* and 51*b*. The lock gears 51*b* and 51*c* are connected to each other through three transmission gears 70*b*, 71*c* and 72*c* disposed between the lock gears 51*b* and 51*c*. The lock gears 51*c* and 51*d* are connected to each other through three transmission gears 70*c*, 71*d* and 72*d* disposed between the lock gears 51*c* and 51*d*.

Accordingly, when the key 90 is inserted into the key hole 14*a* of the tag 14 provided in the printer body 1*a* and the key 90 is rotated in the illustrated arrow direction (clockwise), the lock gear 51*a* rotate in the arrow direction together with the tag 14. This rotation is transmitted to the lock gears 51*b*, 51*c* and 51*d* in the lower paper feed cassettes 6*b*, 6*c* and 6*d* through the transmission gears 70*a*, 71*b*, 72*b*, 70*b*, 71*c*, 72*c*, 70*c*, 71*d* and 72*d*. In such a manner, all the gears rotate in the arrow direction in FIG. 1 substantially concurrently.

Incidentally, in this embodiment, the printer body 1*a* has one lock gear and one transmission gear, and each paper feed cassette unit 1*b*, 1*c*, 1*d* has one lock gear and three transmission gears. The lowest transmission gear 70*d* provided in the paper feed cassette unit 1*d* disposed undermost does not serve to transmit the gear rotation. For example, when another paper feed cassette unit is further stacked under the paper feed cassette unit 1*d*, the transmission gear 70*d* will serve as a transmission gear.

With the rotations of the plurality of gears, the locking bars 52*a*, 52*b*, 52*c* and 52*d* and the hooks 53*a*, 53*b*, 53*c* and 53*d* fixed to the cylinders 54*a*, 54*b*, 54*c* and 54*d* respectively also rotate in the arrow direction in FIG. 1, respectively. As soon as the key 90 rotates to reach the position of the locked state, the locking bars 52*a*, 52*b*, 52*c* and 52*d* are received in the recess portions 55*a*, 55*b*, 55*c* and 55*d* of the paper feed cassettes 6*a*, 6*b*, 6*c* and 6*d*, while the hooks 53*a*, 53*b*, 53*c* and 53*d* move in the unit stack direction, that is, downward so as to engage with the hook destinations 80*b*, 80*c* and 80*d* and the printer fixing bar 201 fixed onto the support base 200, respectively.

Incidentally, the locking bars 52*a*, 52*b*, 52*c* and 52*d* are removable. For example, therefore, when only the locking bar 52*b* is removed, only the paper feed cassette 6*b* in the paper feed cassette unit 1*b* will avoid gang locking and keep its unlocked state even if the other three paper feed cassettes 6*a*, 6*c* and 6*d* are brought into the locked state.

The locking gears 51*a*, 51*b*, 51*c* and 51*d*, the locking bars 52*a*, 52*b*, 52*c* and 52*d*, the hooks 53*a*, 53*b*, 53*c* and 53*d* and the transmission gears 70*a*, 71*b*, 72*b*, 70*b*, 71*c*, 72*c*, 70*c*, 71*d*, 72*d* and 70*d* constituting the gang lock units are stored in the printer body 1*a* and the paper feed cassette units 1*b*, 1*c* and 1*d* respectively, and prevented from projecting outside the apparatus even when the paper feed cassettes 6*a*, 6*b*, 6*c* and 6*d* are in the locked state.

Figure 2:
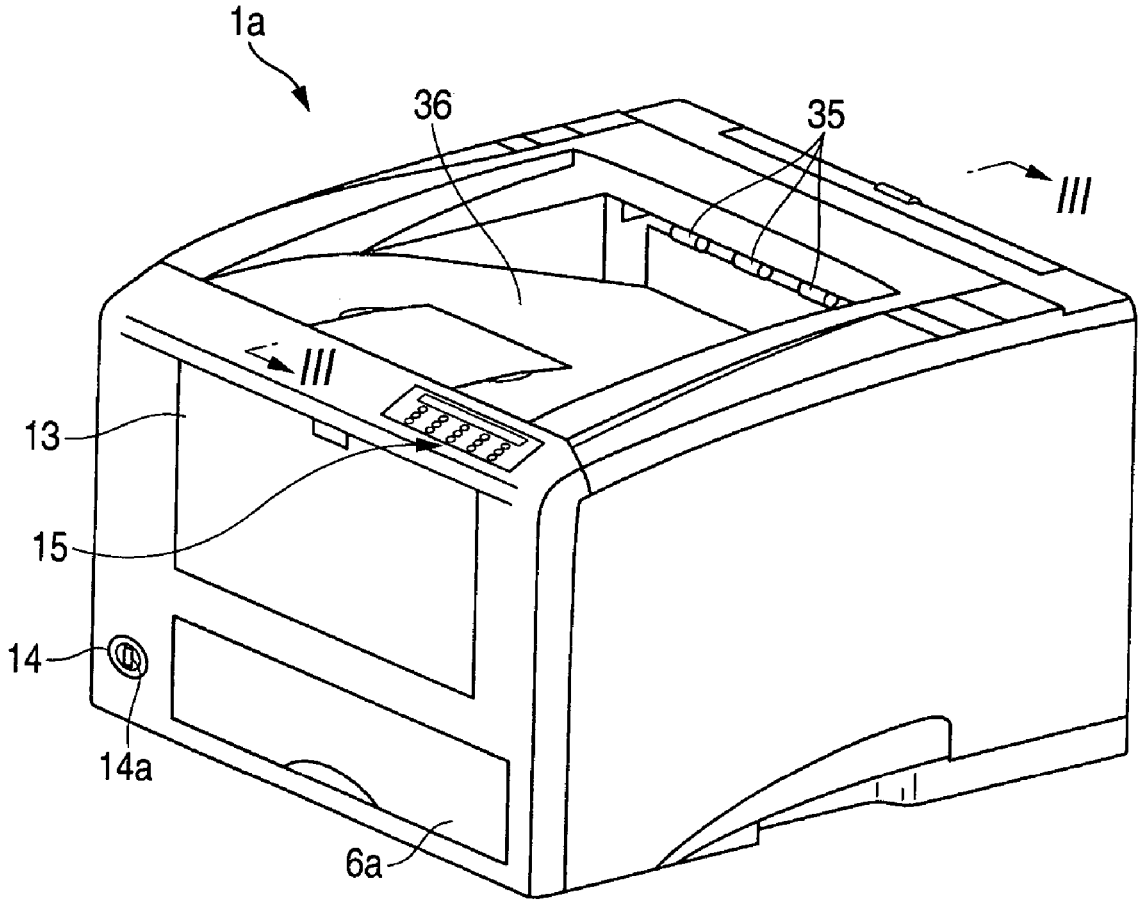
FIG. 2 is a schematic perspective view showing a printer body in the laser printer in FIG. 1.
Figure 3:
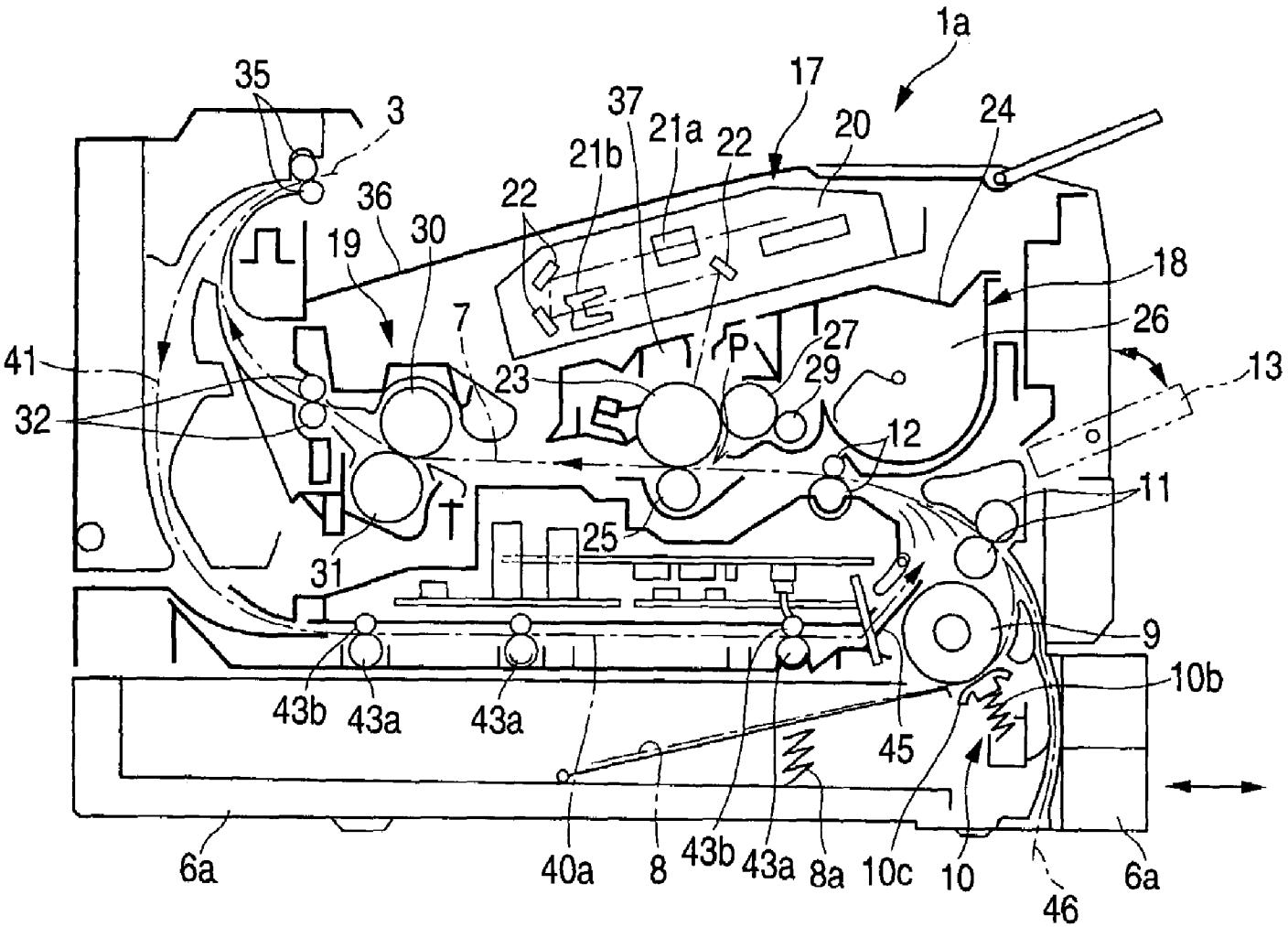
FIG. 3 is a sectional view taken on line III-III in FIG. 2.

Next, the printer body 1*a* of the laser printer 1 will be described in detail with reference to FIGS. 1 to 3. FIG. 2 is a schematic perspective view showing the printer body 1*a* in the laser printer 1 in FIG. 1. FIG. 3 is a sectional view taken on line III-III in FIG. 2.

As shown in FIGS. 1 and 2, a manual paper feed tray 13 is installed openably and closably above the paper feed cassette 6*a* of the printer body 1*a*. An operating portion 15 is provided in a surface formed further above the manual paper feed tray 13 and obliquely from the side surface of the printer to the top thereof as shown in FIG. 2. The operating portion 15 is provided with a liquid crystal display 15*a* and a plurality of buttons 15*b*. Settings in the laser printer 1 are shown in the liquid crystal display 15*a*. When the user pushes the buttons 15*b*, the user can do various settings on the laser printers 1.

The check 3 fed from the paper feed cassette 6*a* or the manual paper feed tray 13 in the printer body 1*a* is subjected to print processing through the process in which the check 3 is carried along a feed path inside the printer body 1*a* as will be described later. Then, the check 3 is delivered onto a paper outlet tray 36 by the rotations of a paper delivery roller pair 35 shown in FIGS. 2 and 3.

Here, the internal configuration of the printer body 1*a* will be described with reference to FIG. 3. First, a pressure plate 8, a paper feed roller 9 and a separation pad unit 10 are provided inside the paper feed cassette 6*a* mounted in the lower portion of the printer body 1*a*. The paper feed roller 9 is provided above a one-end-side end portion of the paper feed cassette 6*a*. The paper feed roller 9 rotates intermittently.

The pressure plate 8 has a top on which the checks 3 can be laid, and a bottom urged upward by a spring 8*a*. In addition, the pressure plate 8 is supported swingably at one end more distant from the paper feed roller 9. Thus, the other end of the pressure plate 8 closer to the paper feed roller 9 is made movable in the up/down direction. The paper feed roller 9 and the separation pad unit 10 are disposed to face each other. A separation pad (not shown) made from a member having a high friction drag is pressed toward the paper feed roller 9 by a spring 10*b* disposed on the back side of a pad backing 10*c* in the separation pad unit 10.

The check 3 fed from the paper feed cassette 6*a* is fed to a feed roller pair 11 and a resist roller pair 12 through the paper feed roller 9 and the separation pad unit 10 along a feed path 7 shown by the chain line in FIG. 3. The check 3 is corrected for skewing in the position of the resist roller pair 12. The check 3 corrected for skewing is then sent to an image forming position P of the process unit 18 (a contact portion between a photoconductor drum 23 and a transfer roller 25 which will be described later, that is, a transfer position where a toner image on the photoconductor drum 23 is transferred to the check 3), and subjected to printing therein.

The process unit 18 is constituted by a drum cartridge, a developing cartridge 24, and so on. The drum cartridge includes the photoconductor drum 23, a Scorotron type charger 37 serving as a charging unit, the transfer roller 25 serving as a transfer unit, and so on. The developing cartridge 24 can be removably attached to the drum cartridge. The developing cartridge 24 has a toner storage portion 26, a developing roller 27 serving as a developing unit, a layer thickness limiting blade (not shown), a toner feed roller 29, etc. Incidentally, the toner storage portion 26 is filled with mica toner containing magnetic powder and suitable for the check 3 used as a recording medium as in this embodiment. A toner image carried on the surface of the photoconductor drum 23 is transferred to the check 3 when the check 3 passes between the photoconductor drum 23 and the transfer roller 25.

In addition, a scanner unit 17 is disposed on the lower surface side of the paper outlet tray 36. The scanner unit 17 has a laser beam emitting portion (not shown), a polygon mirror 20 to be driven to rotate, lenses 21*a* and 21*b*, a reflecting mirrors 22, etc. Then, a laser beam emitted from the laser beam emitting portion in accordance with given image data is passed through or reflected on the polygon mirror 20, the lens 21*a*, the reflecting mirrors 22 and the lens 21*b* in that order. Thus, the surface of the photoconductor drum 23 serving as a photoconductor in the process unit 18 is scanned and irradiated with the laser beam at a high speed.

A fixing unit 19 serving as fixing means to thermally fix the image on the check 3 is disposed on the downstream side of the process unit 18 along the feed path 7. The fixing unit 19 has a heating roller 30, a pressure roller 31 disposed to press the heating roller 30, and a feed roller pair 32 provided on the downstream side of the rollers 30 and 31. The heating roller 30 is made from metal such as aluminum, and provided with a heater such as a halogen lamp for heating so that the toner transferred onto the check 3 in the process unit 18 is fixed thermally when the check 3 passes between the heating roller 30 and the pressure roller 31. After that, the check 3 is carried to the position of the paper delivery roller pair 35 by the feed roller pair 32.

Incidentally, the laser printer 1 according to this embodiment can perform double-sided printing. However, the laser printer 1 is generally set for single-sided printing when the check 3 is used as a recording medium. In setting of single-sided printing, the check 3 carried to the delivery roller pair 35 after the single-sided printing is delivered onto the paper outlet tray 36 by the rotation of the paper delivery roller pair 35.

On the other hand, for example, assume that setting is done for double-sided printing when a sheet of plain paper is used as a recording medium. In such a case, the front and back of the sheet of plain paper fed to the paper delivery roller pair 35 after single-sided printing are reversed due to the reverse rotation of the paper delivery roller pair 35, and fed toward the resist roller pair 12 again along a reverse path 41 and a refeed path 40*a* following the reverse path 41. In the refeed path 40*a*, the sheet of paper is carried while being held between a plurality of pairs of refeed rollers 43*a* and 43*b* disposed at a distance from one another, and fed to the resist roller pair 12 again through a refeed guide 45. Then, the sheet of paper is subjected to printing on the other unprinted side thereof by the process unit 18. The sheet of paper after the double-sided printing is delivered onto the paper outlet tray 36 due to the rotation of the paper delivery roller pair 35 as described above.

Incidentally, description has been made above on the case where the check 3 is fed from the paper feed cassette 6*a* provided in the printer body 1*a*. However, the check 3 can be selectively fed also from the paper feed cassette 6*b*, 6*c*, 6*d* in the paper feed cassette unit 1*b*, 1*c*, 1*d* shown in FIG. 1, through a paper feed cassette unit feed path 46 (see FIG. 3). Incidentally, a mechanism or control for feeding recording media selectively from paper feed cassette units disposed in a stack are known well. Therefore, their detailed description will be omitted here.

As described above, the laser printer 1 according to the first embodiment has the four paper feed cassettes 6*a*, 6*b*, 6*c* and 6*d* so that various kinds of prints can be stored in the paper feed cassettes 6*a*, 6*b*, 6*c* and 6*d* severally. To bring the paper feed cassettes 6*b*, 6*c* and 6*d* into the locked state, only the paper feed cassette 6*a* having a locking portion is operated so that the other paper feed cassettes 6*b*, 6*c* and 6*d* can be also brought into the locked state concurrently by gang locking. Such a configuration can reduce the cost in comparison with the case where a locking portion is provided for each of the four feed cassettes 6*a*, 6*b*, 6*c* and 6*d*. In addition, the locking operation becomes easy for the user because it will go well if locking is performed on only the paper feed cassette 6*a* having the locking portion without any necessity of performing locking on the paper feed cassettes 6*a*, 6*b*, 6*c* and 6*d* individually.

When all the paper feed cassettes 6*a*, 6*b*, 6*c* and 6*d* are brought into the locked state by gang locking, paper feed cassettes used frequently or unnecessary to be protected from theft are also locked. This may be disadvantage for the user. Such disadvantageous can be solved in this embodiment. That is, the locking bars 52*a*, 52*b*, 52*c* and 52*d* are made removable. A locking bar corresponding to a paper feed cassette unnecessary to be locked is removed, and recording media unnecessary to be protected from theft are stored in the paper feed cassette.

In addition, an apparatus which can solve the disadvantage that a paper feed cassette used frequently or unnecessary to be protected from theft is locked can be realized by a comparatively simple configuration in which the locking bars 52*a*, 52*b*, 52*c* and 52*d* are made removable thus. In addition, the operation to remove the locking bars 52*a*, 52*b*, 52*c* and 52*d* is comparatively easy for the user.

In addition, in response to locking, the hook 53*d* provided in the paper feed cassette 6*d* closest to the support base 200 projects toward the support base 200, and engages with the printer fixing bar 201 provided in the support base 200. The laser printer 1 can be fixed to the support base 200 in concurrence with locking by such a comparatively simple configuration. The event that securities are carried away and stolen together with the laser printer 1 can be prevented easily and at a low price.

Although the three paper feed cassette units 1*b*, 1*c* and 1*d* are used in this embodiment, a desired number of paper feed cassette units can be attached to the printer body 1*a*. Thus, the options of the user can be broadened and the degree of freedom of the laser printer 1 is improved.

When gang locking is performed in response to locking, the printer body 1*a* and the paper feed cassette units 1*b*, 1*c* and 1*d* removably attached to the printer body 1*a* are fixed to one other. It is therefore possible to prevent the event that securities are stolen together with each paper feed cassette unit 1*b*, 1*c*, 1*d* removed from the printer body 1*a*.

More in particular, in response to locking, the lock gears 51*a*, 51*b* and 51*c* rotate so that the hooks 53*a*, 53*b* and 53*c* move toward the paper feed cassette units 1*b*, 1*c* and 1*d*, and engage with the hook destinations 80*b*, 80*c* and 80*d* provided in the paper feed cassette units which are destinations of the hooks 53*a*, 53*b* and 53*c*, respectively. Thus, the printer body 1*a* and the paper feed cassette units 1*b*, 1*c* and 1*d* disposed in a stack are fixed to one another. Accordingly, a desired number of paper feed cassette units can be installed so that the degree of freedom of the laser printer 1 is improved. In addition, the event that securities are stolen together with each paper feed cassette unit removed from the printer body 1*a* can be prevented easily, at a low price and with a comparatively simple configuration.

In addition, the gang lock unit is constituted by a plurality of gears such as lock gears and transmission gears. Due to such a comparatively simple configuration, a laser printer which can lock a plurality of paper feed cassettes with an easy operation can be manufactured easily and at a low price.

Figure 4:
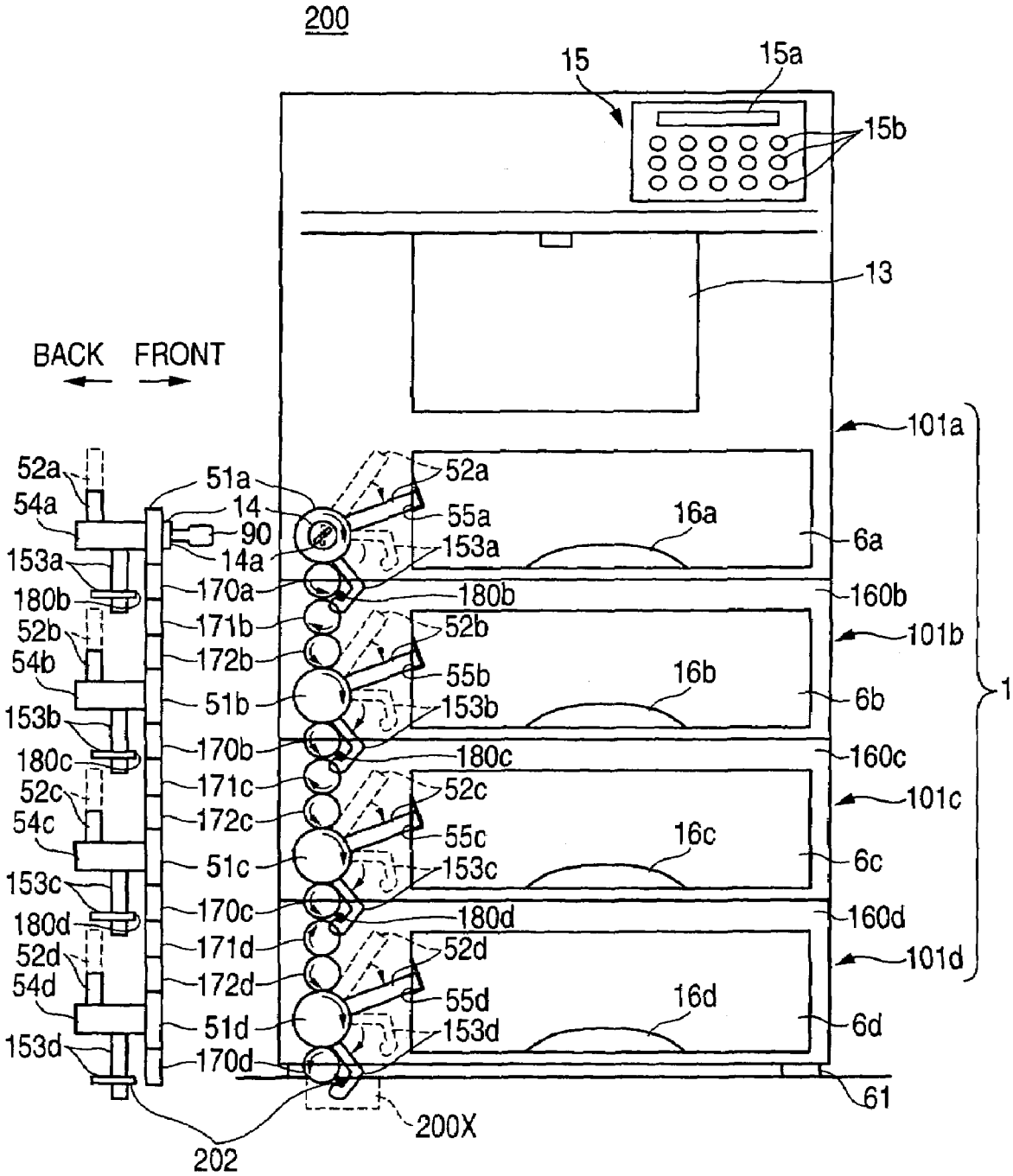
FIG. 4 is a front perspective view showing a laser printer according to a second embodiment of the invention, with an explanatory side view of a gang lock unit provided in the laser printer.

Next, a laser printer according to a second embodiment of the invention will be described with reference to FIG. 4. Here, parts similar in structure to those in the laser printer 1 according to the first embodiment are denoted by the same reference numerals correspondingly, and their description will be omitted. FIG. 4 is a front perspective view showing the laser printer according to the second embodiment of the invention, with an explanatory side view of a gang lock unit provided in the laser printer.

This embodiment is different from the first embodiment in the configuration of the gang lock unit. First, as shown in FIG. 4, each hook 153*a*, 153*b*, 153*c*, 153*d* in this embodiment is received in its corresponding unit in the unhooked state as shown by the broken line in FIG. 4, but it projects downward outside the unit in the hooked state as shown by the solid line.

Figure 5B:
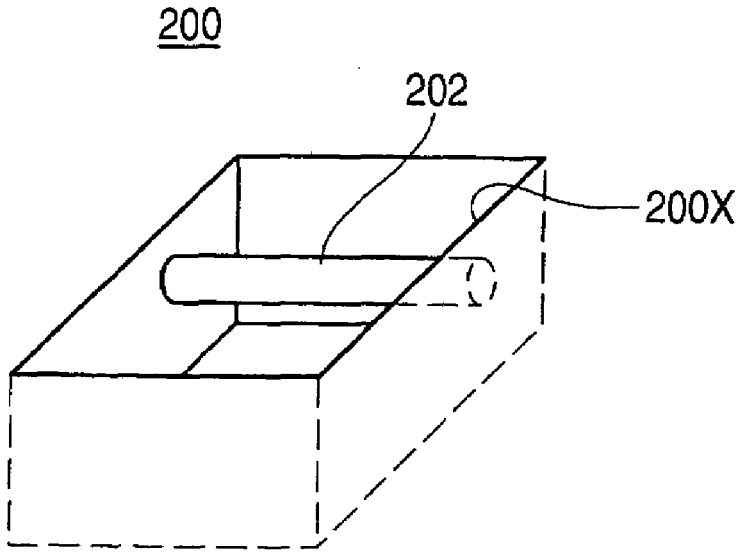
FIG. 5B is a schematic perspective view showing a printer fixing bar provided in a support base for supporting the laser printer according to the second embodiment of the invention.

Hook destinations 180*b*, 180*c* and 180*d* and a printer fixing bar 202 are disposed in positions corresponding to the tips of the hooks in the locked state. In the first embodiment, each hook destination 80*b*, 80*c*, 80*d* is disposed on the top of the unit body 60*b*, 60*c*, 60*d* while the printer fixing bar 201 is attached to project from the surface of the support base 200. In this embodiment, however, each hook destination 180*b*, 180*c*, 180*d* is disposed inside a unit body 160*b*, 160*c*, 160*d* without projecting from the unit body 160*b*, 160*c*, 160*d*, while the printer fixing bar 202 is disposed inside a hole 200*x* formed in the surface of the support base 200 as shown in FIG. 5B.

Each transmission gear is received in the printer body or each unit in the first embodiment. In this embodiment, however, each transmission gear projects outside the apparatus. That is, a transmission gear 170*a* provided in a printer body 101*a* projects downward from the bottom of the printer body 101*a*, and lowest transmission gears 170*b*, 170*c* and 170*d* provided in paper feed cassette units 101*b*, 101*c* and 101*d* respectively project downward from the bottoms of the paper feed cassette units 101*b*, 101*c* and 101*d* respectively. Incidentally, in spite of such a structure where the transmission gears project outside the apparatus, the lowest transmission gear 170*d* is received in a hole 200*x* formed in the surface of the exclusive support base 200 as shown in FIG. 4 when the paper feed cassette unit 101*d* is mounted on the exclusive support base 200. Thus, the laser printer 101 can be supported adequately on the support base 200.

As described above, in the laser printer 101 according to the second embodiment, differently from the laser printer 1 according to the first embodiment, the printer fixing bar 202 does not project from the support base 200. Accordingly, it is possible to avoid such a disadvantage that something is caught by the printer fixing bar 202 after the laser printer 101 has been moved.

However, in this embodiment in which the printer body 101*a* and the paper feed cassette units 101*b*, 101*c* and 101*d* are stacked vertically and supported on the support base 200, they may be put on a support base which is not the exclusive support base 200 having the hole 200*x* formed in the surface. In such a case, at the time of locking, there is a fear that the surface of the support base is injured by the tip of the hook 153*d* provided in the lowest paper feed cassette unit 101*d*, or the hook 153*d* is damaged. On the other hand, in the first embodiment, the hook destinations 80*b*, 80*c* and 80*d* are formed on the tops of the unit bodies 60*b*, 60*c* and 60*d* of the paper feed cassette units 1*b*, 1*c* and 1*d* respectively. It is therefore unnecessary to make the tips of the hooks 53*a*, 53*b* and 53*c* project into the unit bodies 60*b*, 60*c* and 60*d* of the adjacent paper feed cassette units 1*b*, 1*c* and 1*d* respectively. Accordingly, even in the locked state, each hook 53*a*, 53*b*, 53*c* is kept in the printer body 1*a* or the unit body 60*b*, 60*c*, 60*d* of the paper feed cassette unit 1*b*, 1*c*, 1*d* provided therewith. It is therefore possible to solve the disadvantage that the support base is injured or the hook 153*d* is damaged.

Although the preferred embodiments of the invention have been described above, the invention is not limited to the embodiments. Various changes in design can be made on the invention without departing from the claimed scope thereof.

For example, although the embodiments have been described on the case where a laser printer is adopted as an example of an image forming apparatus according to the invention, the invention is also applicable to various image forming apparatuses including other printers of an inkjet type and the like, copying machines, facsimile machines, and so on.

In addition, the toner storage portion 26 in the process unit 18 maybe filled with regular nonmagnetic toner. Although it is suitable to fill the toner storage portion 26 with mica toner containing magnetic powder when securities such as the checks 3 are used as recording media as in the embodiments, it may be filled with nonmagnetic toner when sheets of plain paper are used as recording media.

Although the unlocked/locked state of each paper feed cassette 6*a*, 6*b*, 6*c*, 6*d* is selected by use of a mechanical configuration, that is, a plurality of gears in the embodiments, for example, the unlocked/locked state may be selected by an electronic lock (power lock) or the like.

Figure 6:
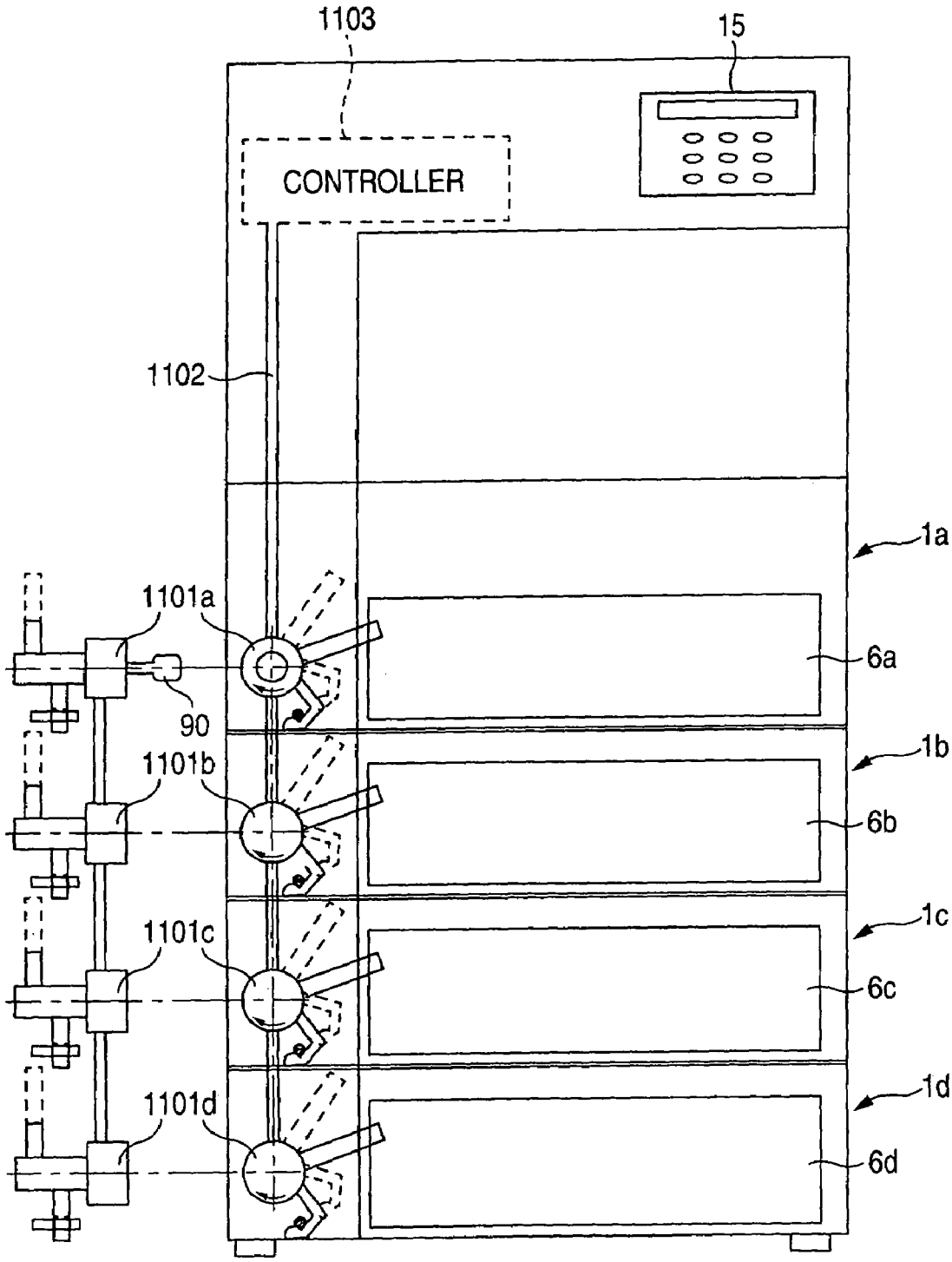
FIG. 6 is a front perspective view showing a laser printer according to another embodiment of the invention, with an explanatory side view of a gang lock unit provided in the laser printer.

For example, FIG. 6 shows a configuration using a power lock. As shown in FIG. 6, the printer body 1*a* and the paper feed cassette units 1*b*, 1*c* and 1*d* are provided with power lock portions 1101*a*, 1101*b*, 1101*c* and 1101*d*. The power lock portions 1101*a*, 1101*b*, 1101*c* and 1101*d* are connected through a bus 1102 to a controller 1103 that is provided in the printer body 1*a*. The controller 1103 is configured to control a locked state and an unlocked state of each of the power lock portions 1101*a*, 1101*b*, 1101*c* and 1101*d*. When the key 90 is inserted into the power lock portion 1101*a* and the key 90 is rotated in the illustrated arrow direction (clockwise), the power lock portion 1101*a* brings the paper feed cassette 6*a* into a locked state. Concurrently, the controller 1103 detects that the power lock portion 1101*a* to be in a locked state, the controller 1103 controls the power lock portions 1101*b*, 1101*c* and 1101*d* to bring into the locked state in accordance with the locked state of the power lock portion 1101*a*. In such a manner, the locked state of the power lock portion 1101*a* is transmitted to the other power lock portions 1101*b*, 1101*c* and 1101*d*. In addition, the controller 1103 may transmit the unlocked state of the power lock portion 1101*a* to the power lock portions 1101*b*, 1101*c* and 1101*d*. The controller may be operated through the operation portion 15.

Figure 7:
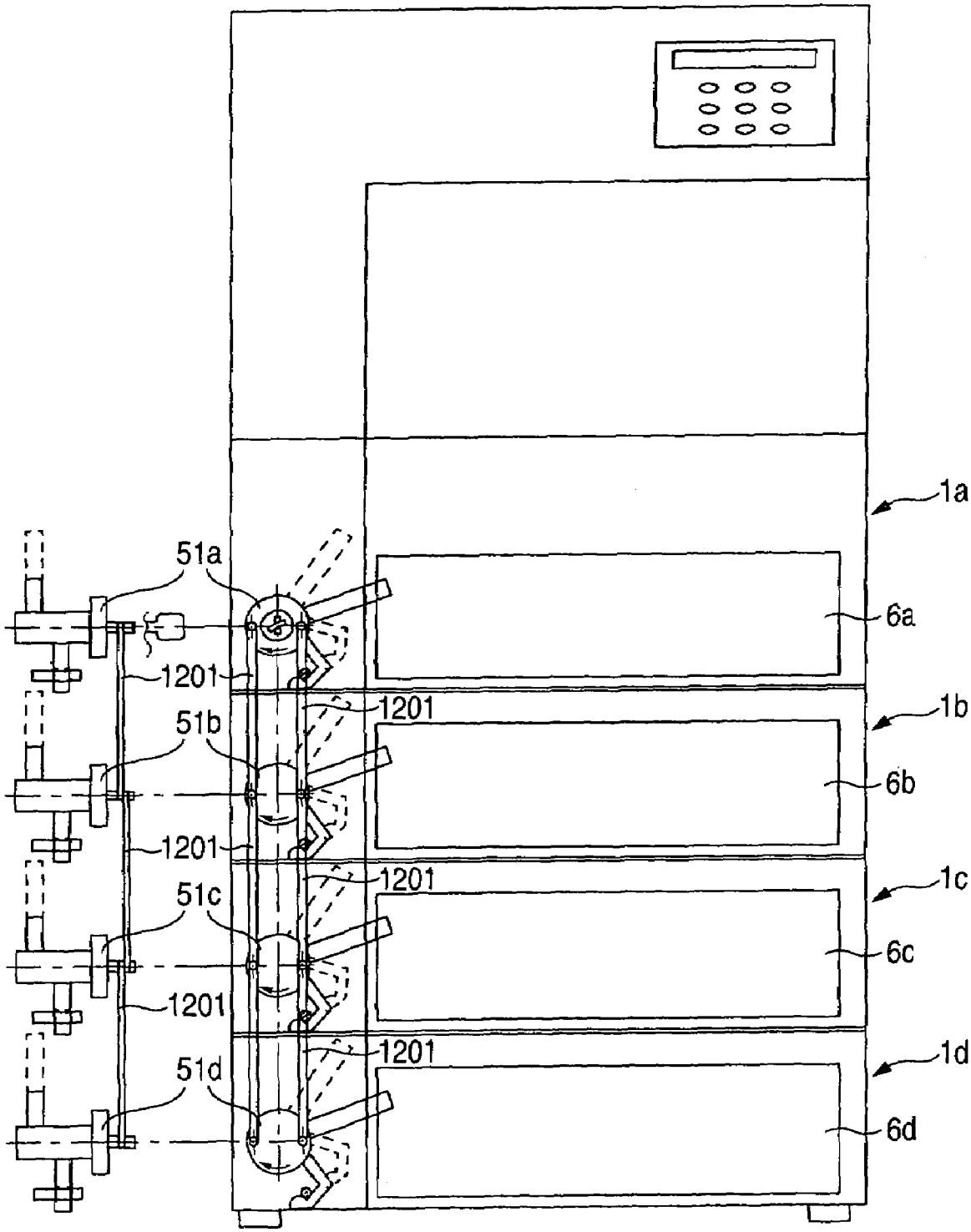
FIG. 7 is a front perspective view showing a laser printer according to another embodiment of the invention, with an explanatory side view of a gang lock unit provided in the laser printer.
Figure 8:
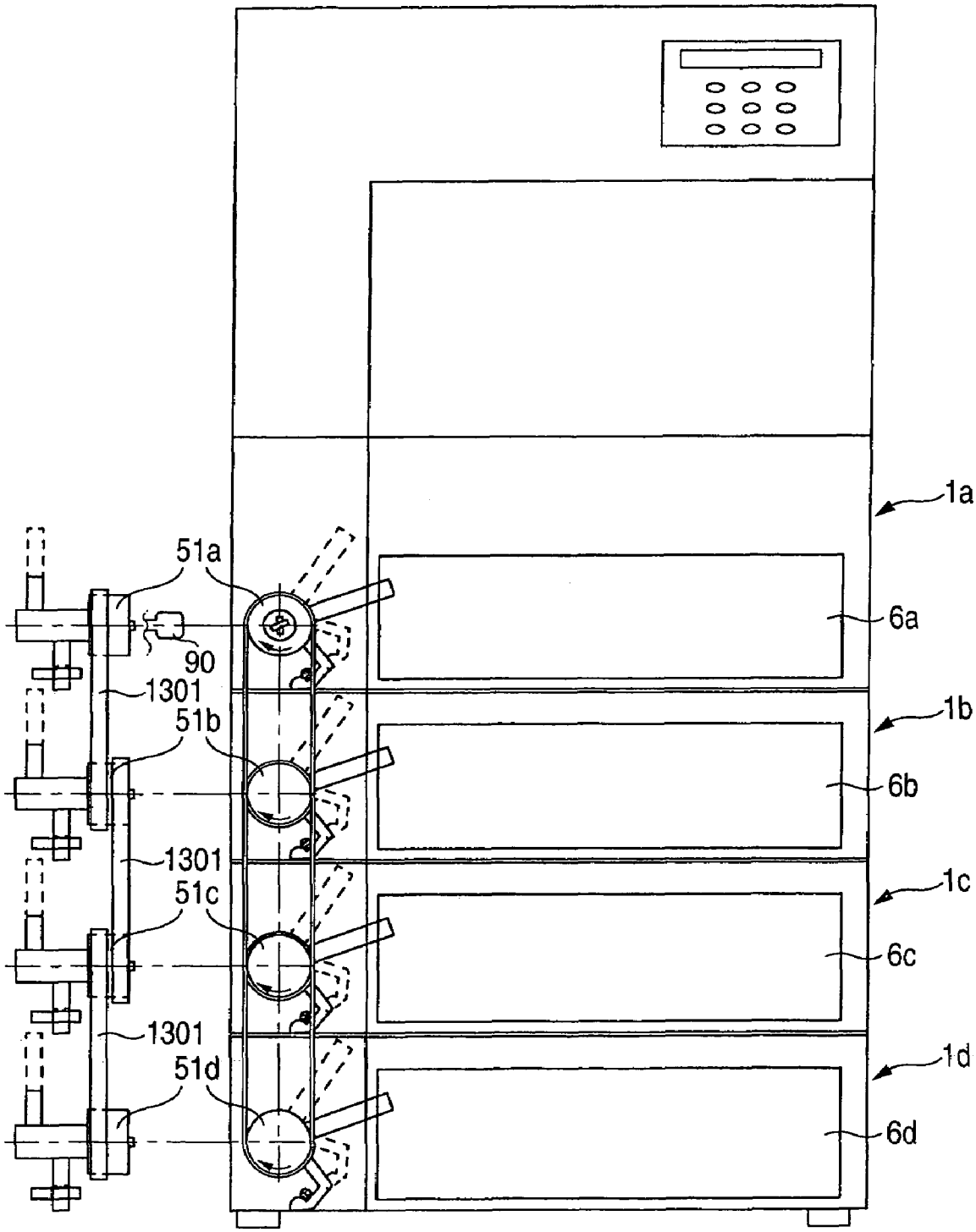
FIG. 8 is a front perspective view showing a laser printer according to another embodiment of the invention, with an explanatory side view of a gang lock unit provided in the laser printer.

Further, the unlocked/locked state of each paper feed cassette 6*a*, 6*b*, 6*c*, 6*d* is selected by use of alternative mechanical configuration, such as a link member, or a belt. FIG. 7 shows a configuration in which the unlocked/locked state of each paper feed cassette 6*a*, 6*b*, 6*c* and 6*d* is selected by use of link members 1201. FIG. 8 shows a configuration in which the unlocked/locked state of each paper feed cassette 6*a*, 6*b*, 6*c*, 6*d* is selected by use of belts 1301. In these configurations, the lock gears 51*a*, 51*b*, 51*c* and 51*d* are mechanically connected with each other by the link members 1201 or the belts. Accordingly, rotation of the lock gear 51*a* is transmitted to the other lock gears 51*b*, 51*c* and 51*d* and gang lock of the paper feed cassette 6*a*, 6*b*, 6*c* and 6*d* are realized.

The transmission gears may be omitted in the embodiments. In this event, adjacent lock gears are designed to be connected to each other directly. Further, various configurations may be adopted for the gang lock unit if it can perform so-called gang locking in which when at least one of paper feed cassettes with a locking portion is brought into the locked state, the other paper feed cassettes having no locking portion are also brought into the locked state automatically.

Although the embodiments have been described on the case where the paper feed cassette 6*a* which is one of the four paper feed cassettes and which is provided in the printer body 1*a* is provided with the key hole 14*a* and so on as a locking portion, the invention is not limited to such a configuration. For example, the locking portion may be provided not in the printer body 1*a* but in one of the paper feed cassette units. Alternatively, a plurality of locking portions may be provided in the paper feed cassette units respectively. The number or assignment of locking portions can be modified variously. However, when the locking portion is provided in the printer body 1*a* while no locking portion is provided in any paper feed cassette unit as in the embodiments, the paper feed cassette units can be made to have the same configuration as one another. It can be therefore noted that the configuration in the embodiments is advantageous in terms of manufacturing or selling of the paper feed cassette units.

Although the paper feed cassettes are provided in the printer body 1*a* and the paper feed cassette units 1*b*, 1*c* and 1*d* separate from one another respectively in the embodiments, two or more paper feed cassettes may be provided in the printer body 1*a* while no paper feed cassette unit is provided. In this case, at least one of the paper feed cassettes provided in the printer body 1*a* is provided with a locking portion.

In addition, the arrangement of the plurality of paper feed cassettes is not limited to a vertical line as in the embodiments. Paper feed cassettes may be arranged horizontally. Alternatively, a plurality of paper feed cassettes are disposed both vertically and horizontally. The same thing applies not only to the arrangement of a plurality of paper feed cassettes provided in one unit but also to the arrangement of paper feed cassette units.

Although the locking bar 52*a*, 52*b*, 52*c*, 52*d* is made removable to avoid gang locking in the embodiments, the invention is not limited to such a configuration. Gang locking may be avoided by various other means. Alternatively, such a unit capable of avoiding gang locking may be not provided.

Although the embodiments have been described on the case where the printer fixing bar 201, 202 provided in the support base 200 for supporting the printer is engaged with a hook provided in a paper feed cassette unit so that the printer can be fixed to the support base concurrently with gang locking of the printer, the invention is not limited to such a configuration. The printer may be fixed to the support base concurrently with gang locking by various other means. Alternatively, such an apparatus fixing unit maybe not provided.

When paper feed cassette units separate from the printer body are provided removably, the printer body and the paper feed cassette units are fixed to one another concurrently with gang locking by engagement between hooks and hook destinations in the embodiments. The invention is not limited to such a configuration. The body and the units may be fixed by various other means. Alternatively, such a unit fixing unit may be not provided.

In the embodiments, the hook provided in a paper feed cassette unit having another paper feed cassette unit disposed thereunder serves to fix the units to each other, while the hook provided in a paper feed cassette having no paper feed cassette unit disposed thereunder and being closest to the support base serves to fix the printer to the support base. That is, each hook has different functions in accordance with its disposition. This is advantageous in terms of reduction in number of parts. However, a unit fixing unit and an apparatus fixing unit may be provided separately. For example, another hook may be provided as an apparatus fixing unit.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. A paper feeder comprising:

a first paper feed cassette in which to store a recording medium with a lock state that is selected from an unlocked state where the recording medium can be taken out therefrom and a locked state where the recording medium cannot be taken out therefrom;

a locking portion that brings the lock state of the first paper feed cassette into the unlocked state or the locked state;

a second paper feed cassette in which to store a recording medium, capable of selectively entering an unlocked state where the recording medium can be taken out therefrom and a locked state where the recording medium cannot be taken out therefrom;

a lock state transmitting portion that transmits the lock state of the first paper feed cassette to the second paper feed cassette to bring the second paper feed cassette into the unlocked state or the locked state in accordance with the lock state of the first paper feed cassette, wherein the lock state transmitting portion mechanically transmits the lock state of the first paper feed cassette to the second paper feed cassette, and wherein the lock state transmitting portion includes:

rotatable lock gears provided for the first paper feed cassette and the second paper feed cassette respectively, lock portions movable in accordance with rotations of the lock gears respectively, and lock reception portions that receive the lock portions at the time of the locked state respectively;

the lock gears are connected with each other so that rotation is transmitted therebetween; and a plurality of transmission gears that connect the lock gears with each other and transmit rotation therebetween.

2. The paper feeder according to claim 1, wherein the first paper feed cassette is provided integrally with the locking portion.

3. The paper feeder according to claim 1, wherein the second paper feed cassette includes an avoidance unit that allows the second paper feed cassette to avoid being brought into the locked state by the lock state transmitting portion.

4. The paper feeder according to claim 1, further comprising:

an apparatus fixing unit that fixes the paper feeder to a support base when the locking portion brings the lock state of the first paper feed cassette into the locked state.

5. The paper feeder according to claim 1, further comprising:

a first paper feed cassette unit including the first paper feed cassette; and a second paper feed cassette unit including the second paper feed cassette;

wherein the first paper feed cassette unit and the second paper feed cassette unit are separated from each other, being removably attached to each other.

6. The paper feeder according to claim 5, further comprising:

a unit fixing unit that fixes the first paper feed cassette unit to the second paper feed cassette unit when the locking portion is operated to bring the lock state of the first paper feed cassette into the locked state.

7. The paper feeder according to claim 6, wherein one of the first paper feed cassette unit and the second paper feed cassette unit is an image forming apparatus body of an image forming apparatus.

8. The paper feeder according to claim 1, wherein at least one of the lock portions is removable.

9. The paper feeder according to claim 1, wherein one of the first paper feed cassette and the second paper feed cassette that is disposed closer to a support base for supporting the paper feeder than the other has a support base hook that projects toward the support base in accordance with rotations of the lock gears so as to engage with a paper feeder fixing portion provided in the support base.

10. The paper feeder according to claim 1, further comprising:

a first paper feed cassette unit including the first paper feed cassette;

a second paper feed cassette unit including the second paper feed cassette, the first paper feed cassette unit and the second paper feed cassette unit being separated from each other and removably attached to each other in a stack; and a hook provided for at least one of the first paper feed cassette and the second paper feed cassette, the hook being movable in a direction of the stack in accordance with rotations of the lock gear associated therewith;

wherein at least one of the first paper feed cassette unit and the second paper feed cassette unit is provided with an engagement portion engagable with the hook.

11. The paper feeder according to claim 9, further comprising:

a first paper feed cassette unit including the first paper feed cassette;

a second paper feed cassette unit including the second paper feed cassette, wherein at least one of the first paper feed cassette unit and the second paper feed cassette unit includes a unit body having a top on which an engagement portion is formed.

12. The paper feeder according to claim 11, wherein one of the first and second paper feed cassette units is an image forming apparatus body of an image forming apparatus.

13. The paper feeder according to claim 1, further comprising:

at least one more paper feed cassette in which to store a recording medium, capable of selectively entering an unlocked state where the recording medium can be taken out therefrom and a locked state where the recording medium cannot be taken out therefrom;

wherein the lock state transmitting portion further transmits the lock state of the first paper feed cassette to the at least one more paper feed cassette to bring the at least one more paper feed cassette into the unlocked state or the locked state in accordance with the lock state of the first paper feed cassette.

* * * * *